US009770731B1

(12) United States Patent
Chen

(10) Patent No.: US 9,770,731 B1
(45) Date of Patent: Sep. 26, 2017

(54) WATER SPRAY GUN

(71) Applicant: Chin-Yuan Chen, Changhua (TW)

(72) Inventor: Chin-Yuan Chen, Changhua (TW)

(73) Assignee: Shin Tai Spurt Water of The Garden Tools Co. Ltd., Changhua (TW)

( * ) Notice: Subject to any disclaimer, the term of this patent is extended or adjusted under 35 U.S.C. 154(b) by 0 days.

(21) Appl. No.: 15/255,486

(22) Filed: Sep. 2, 2016

(51) Int. Cl.
*B05B 9/01* (2006.01)
*B05B 1/32* (2006.01)

(52) U.S. Cl.
CPC ..... *B05B 9/01* (2013.01); *B05B 1/326* (2013.01)

(58) Field of Classification Search
CPC .. B05B 9/01; B05B 1/326; B05B 1/32; B05B 1/3026
See application file for complete search history.

(56) References Cited

U.S. PATENT DOCUMENTS 4,776,517 A * 10/1988 Heren ..... B05B 1/3013 239/391
4,997,131 A * 3/1991 Heren ..... B05B 9/01 239/397.5
7,533,833 B2 * 5/2009 Wang ..... B05B 1/1681 239/443
2016/0040404 A1 * 2/2016 Carpenter-Crawford E03C 1/0405 4/654

* cited by examiner

*Primary Examiner* — Christopher Kim
(74) *Attorney, Agent, or Firm* — Che-Yang Chen; Law Office of Scott Warmuth

(57) ABSTRACT

A water spray gun may comprise a main body, a water outlet unit, a spray head and a knob. The main body has a handle and a barrel portion, and interior spaces of the handle and the barrel portion are communicated with each other. A rear end and a front end of the water outlet unit respectively comprise a first connecting portion and a second connecting portion. The spray head is integrally made of plastic material, which simplifies the manufacturing process and lowers the cost, and through communicating the first through hole with the second through holes, the water flow is configured to flow in a straight line thus maintaining the momentum and speed of the water flow to perform different spraying patterns efficiently and to save labors and water.

4 Claims, 7 Drawing Sheets

WATER SPRAY GUN

FIELD OF THE INVENTION

The present invention relates to a water spray gun, and more particularly to a water spray gun capable of lowering manufacturing cost and achieving a great spraying performance.

BACKGROUND OF THE INVENTION

Generally, referring to FIGS. 6 and 7, a conventional water spray gun comprises a main body (50) and a spray head (60), and the main body (50) further has a handle (51) and a barrel portion (52). A water outlet unit (53) is formed at a front end of the barrel portion (52) while a valve rod (54) is located at an interior space thereof. Also, the valve rod (54) further has a sealing pad (541), and a rear end of the valve rod (54) protruding from the main body (50) is connected to a pressing unit (55) which is pivotally engaged with the handle (51). The pressing unit (55) is configured to control on/off operation of water flow by driving the valve rod (55) to shift inside the barrel portion (52). A spring (56) is borne against between the valve rod (54) and a lateral end of the barrel portion (52), and an interior space of the water outlet unit (53) has a water channel (531) which comprises an opening at a rear end thereof. A front end of the water channel (531) has two water outlet holes (532) which laterally penetrate the water outlet unit (53) and are located at corresponding positions, and the spray head (60) is connected to a front end of the water outlet unit (53) by screws. Also, a stepped rod (533) is formed at a front end of the water outlet unit (53), and a front end of the spray head (60) has a tapered spout (61). As a result, a user can turn the spray head (60) to adjust a separated distance between the stepped rod (533) and the spout (61) to change patterns of spraying water such as solid stream (as shown in FIG. 6), full cone (as shown in FIG. 7), and etc.

However, the conventional water spray gun has following disadvantages: (i) since the spray head is usually made of metal such as copper ingot by turning processing, the manufacturing process is complicate and the cost is higher; and (ii) before spraying out from the tapered spout (61), water needs to flow from the opening of the water channel (531) through the water channel (531), the water outlet unit (53) and the water outlet holes (533) into the spray head (60), which has multiple transitions and reduces the momentum of flow and the spraying range of water flow, resulting in wasting time and water in large-scale water spraying. Therefore, there remains a need for a new and improved design for a water spray gun to overcome the problems presented above.

SUMMARY OF THE INVENTION

The present invention provides a water spray gun which comprises a main body, a water outlet unit, a spray head and a knob. The main body has a handle and a barrel portion, and interior spaces of the handle and the barrel portion are communicated with each other. A connecting opening formed at a front end of the barrel portion is configured to receive and secure the water outlet unit, and a rear end and a front end of the water outlet unit respectively comprise a first connecting portion and a second connecting portion. A central portion of the first connecting portion has a first through hole which axially extends to a central portion of the second connecting portion, and a mounting base having a screw hole is received in a front portion of the first through hole. Furthermore, the mounting base is connected with the second connecting portion through a plurality of spacers, and a plurality of second through holes formed between the spacers are communicated with the first through hole. As a result, water flowing through the water spray gun is configured to flow in a straight line, which is a way to keep the momentum and speed of water flow. Moreover, the water outlet unit is received in the connecting opening of the main body through the first connecting portion, and the second connecting portion of the water outlet unit protrudes from the barrel portion of main body. In addition, an outer periphery of the second connecting portion has a first threaded segment which is configured to engage and secure the spray head. The spray head integrally made of plastic material is connected with an outer casing and an inner tube, and a second threaded segment formed at an inner surface of the inner tube is configured to engage with the first threaded segment of the second connecting portion of the water outlet unit. A front end of the inner tube further comprises a tapered stepped portion which is configured to connect to a tilted surface, and a diameter of the stepped portion is gradually expanded from a rear end to a front end. The knob has a blocking piece, and a threaded rod protruding from a first end of the blocking piece is configured to penetrate through the tilted surface to connect to the screw hole of the mounting base.

Comparing with conventional water spray gun, the present invention is advantageous because: (i) the spray head is integrally made of plastic material, which simplifies the manufacturing process and lowers the cost; and (ii) through communicating the first through hole with the second through holes, the water flow is configured to flow in a straight line thus maintaining the momentum and speed of the water flow to perform different spraying patterns efficiently and to save labors and water.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
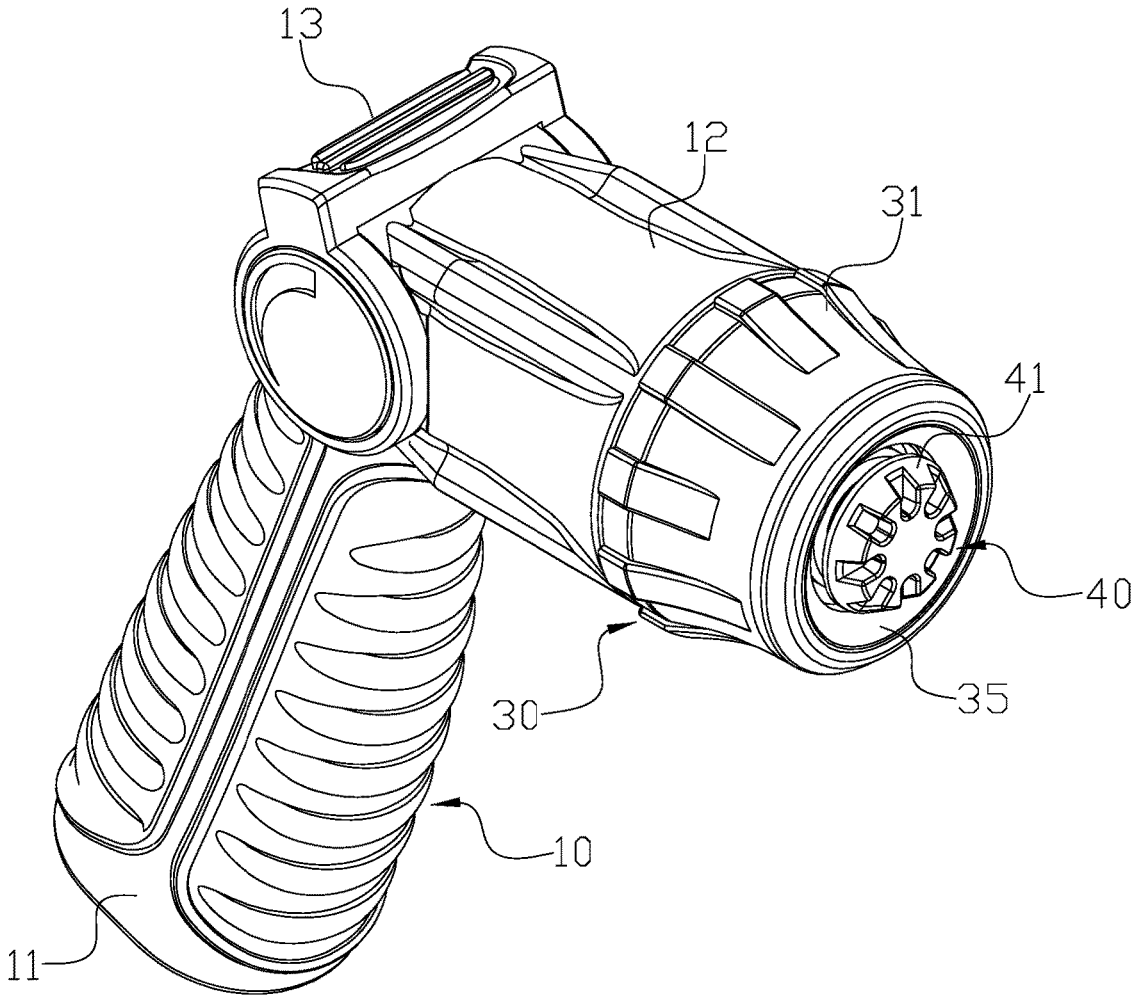
FIG. 1 is a three-dimensional assembly view of a water spray gun in the present invention.
Figure 2:
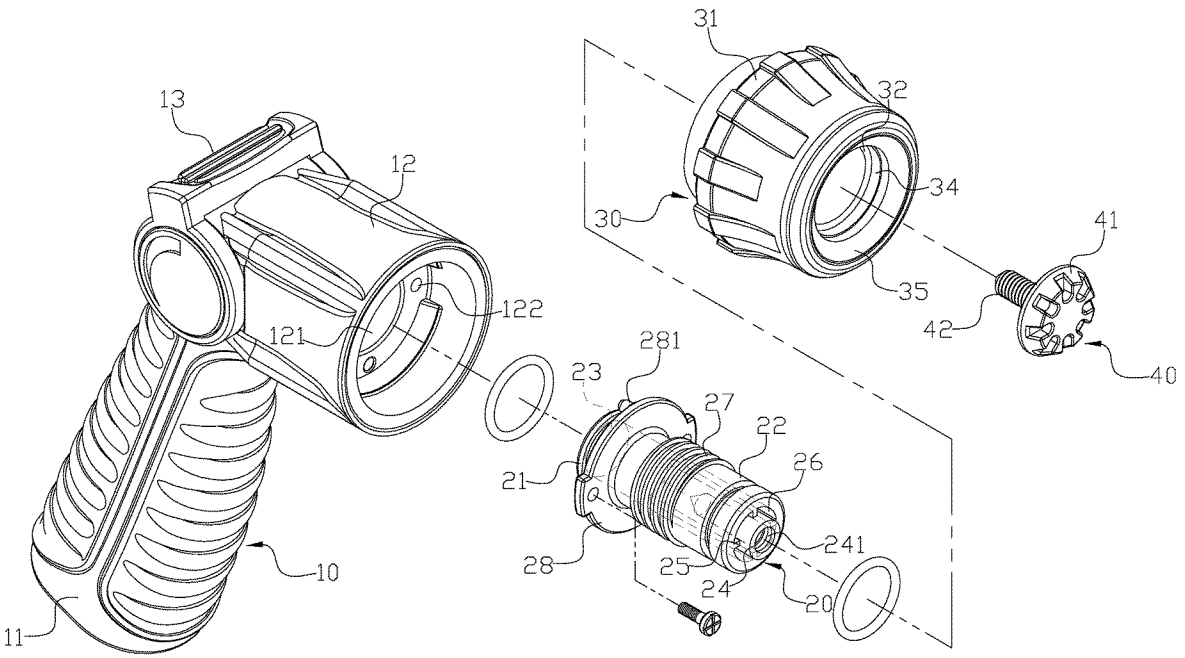
FIG. 2 is a three-dimensional exploded view of the water spray gun in the present invention.
Figure 3:
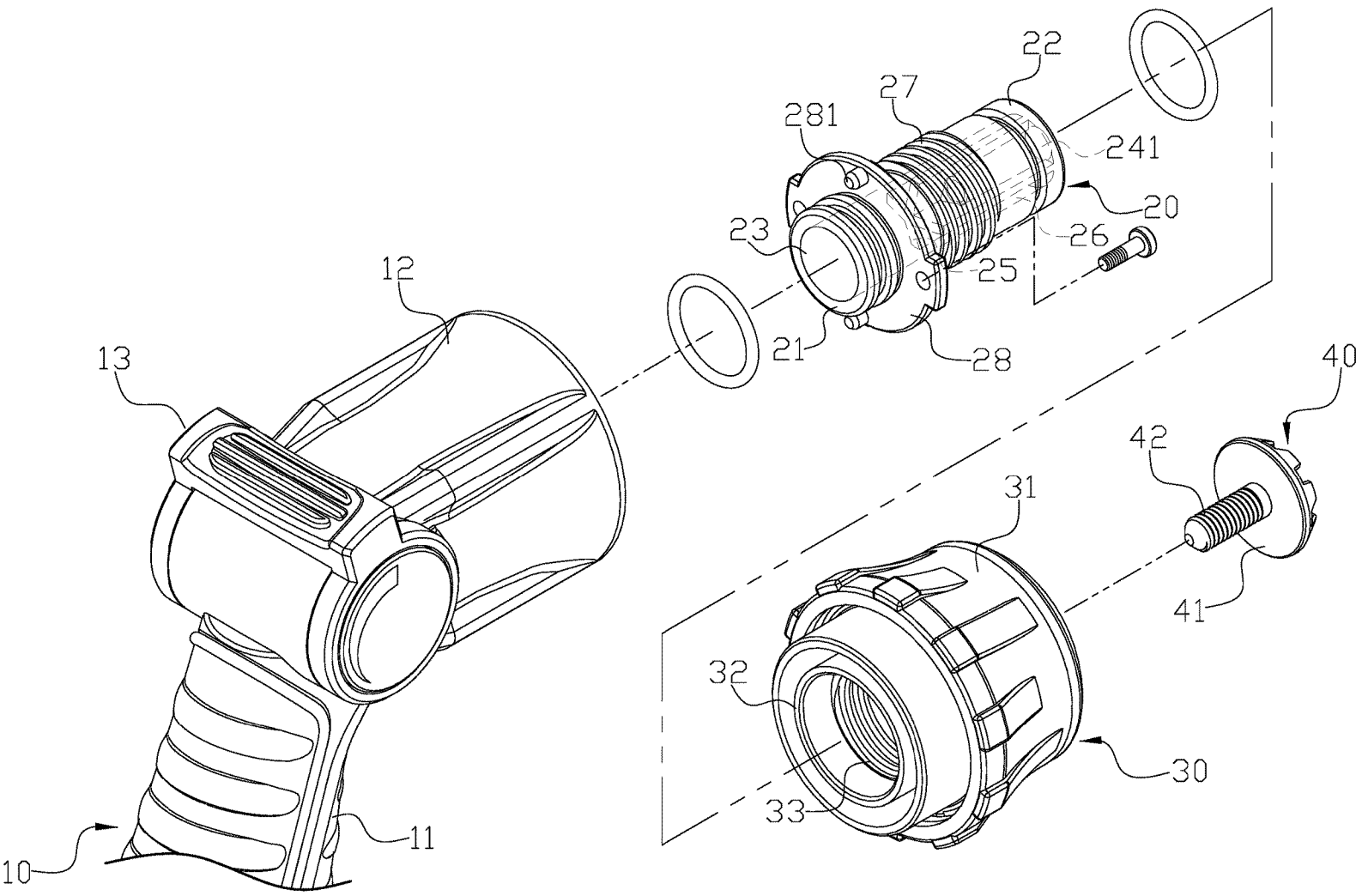
FIG. 3 is a three-dimensional exploded view from another angle of the water spray gun in the present invention.

In order to further understand the goal, characteristics and effect of the present invention, a number of embodiments along with the drawings are illustrated as following:

Referring to FIGS. 1 to 3, the present invention provides a water spray gun which comprises a main body (10), a water outlet unit (20), a spray head (30) and a knob (40). The main body (10) has a handle (11) and a barrel portion (12), and interior spaces of the handle (11) and the barrel portion (12) are communicated with each other. A connecting opening (121) formed at a front end of the barrel portion (121) is configured to receive and secure the water outlet unit (20), and a rear end and a front end of the water outlet unit (20) respectively comprise a first connecting portion (21) and a second connecting portion (22). A central portion of the first connecting portion (21) has a first through hole (23) which axially extends to a central portion of the second connecting portion (23), and a mounting base (24) having a screw hole (241) is received in a front portion of the first through hole (23). Furthermore, the mounting base (24) is connected with the second connecting portion (22) through a plurality of spacers (25), and a plurality of second through holes (26) formed between the spacers (25) are communicated with the first through hole (23). As a result, water flowing through the water spray gun is configured to flow in a straight line, which is a way to keep the momentum and speed of water flow. Moreover, the water outlet unit (20) is received in the connecting opening (121) of the main body (10) through the first connecting portion (21), and the second connecting portion (22) of the water outlet unit (20) protrudes from the barrel portion (12) of main body (10). In addition, an outer periphery of the second connecting portion (22) has a first threaded segment (27) which is configured to engage and secure the spray head (30). The spray head (30) integrally made of plastic material is connected with an outer casing (31) and an inner tube (32), and a second threaded segment (33) formed at an inner surface of the inner tube (32) is configured to engage with the first threaded segment (27) of the second connecting portion (22) of the water outlet unit (20). A front end of the inner tube (32) further comprises a tapered stepped portion (34) which is configured to connect to a tilted surface (35), and a diameter of the stepped portion (34) is gradually expanded from a rear end to a front end. The knob (40) has a blocking piece (41), and a threaded rod (42) protruding from a first end of the blocking piece (41) is configured to penetrate through the tilted surface (35) to connect to the screw hole (241) of the mounting base (24).

In one embodiment, a water valve (13) formed between the handle (11) and the barrel portion (12) of the main body (10) is configured to control on/off operation of the main body (10) to spray water flow.

In another embodiment, the spacers (25) located on the water outlet unit (20) are formed in cross-shaped.

In a further embodiment, a flange (28) is formed between the first connecting portion (21) and the second connecting portion (22), and a locating column (281) protruding from a first surface of the flange (28) is configured to connect to a locating hole (122) formed at the connecting opening (121) of the barrel portion (12) of the main body (10). With the use of screws, the water outlet unit (20) is configured to be firmly secured on the main body (10).

Figure 4:
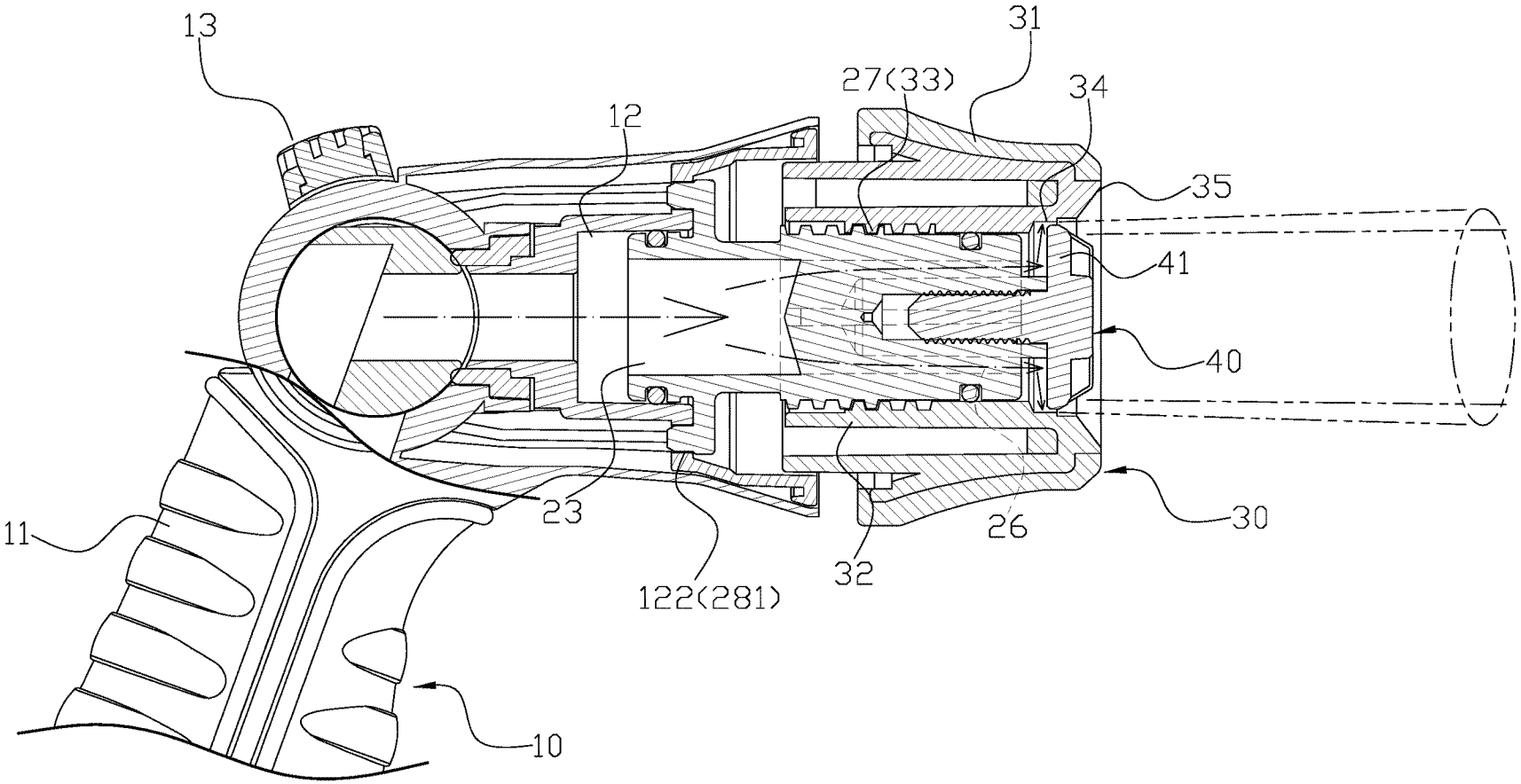
FIG. 4 is a schematic view illustrating the water spray gun of the present invention sprays water flow in a solid stream pattern.
Figure 5:
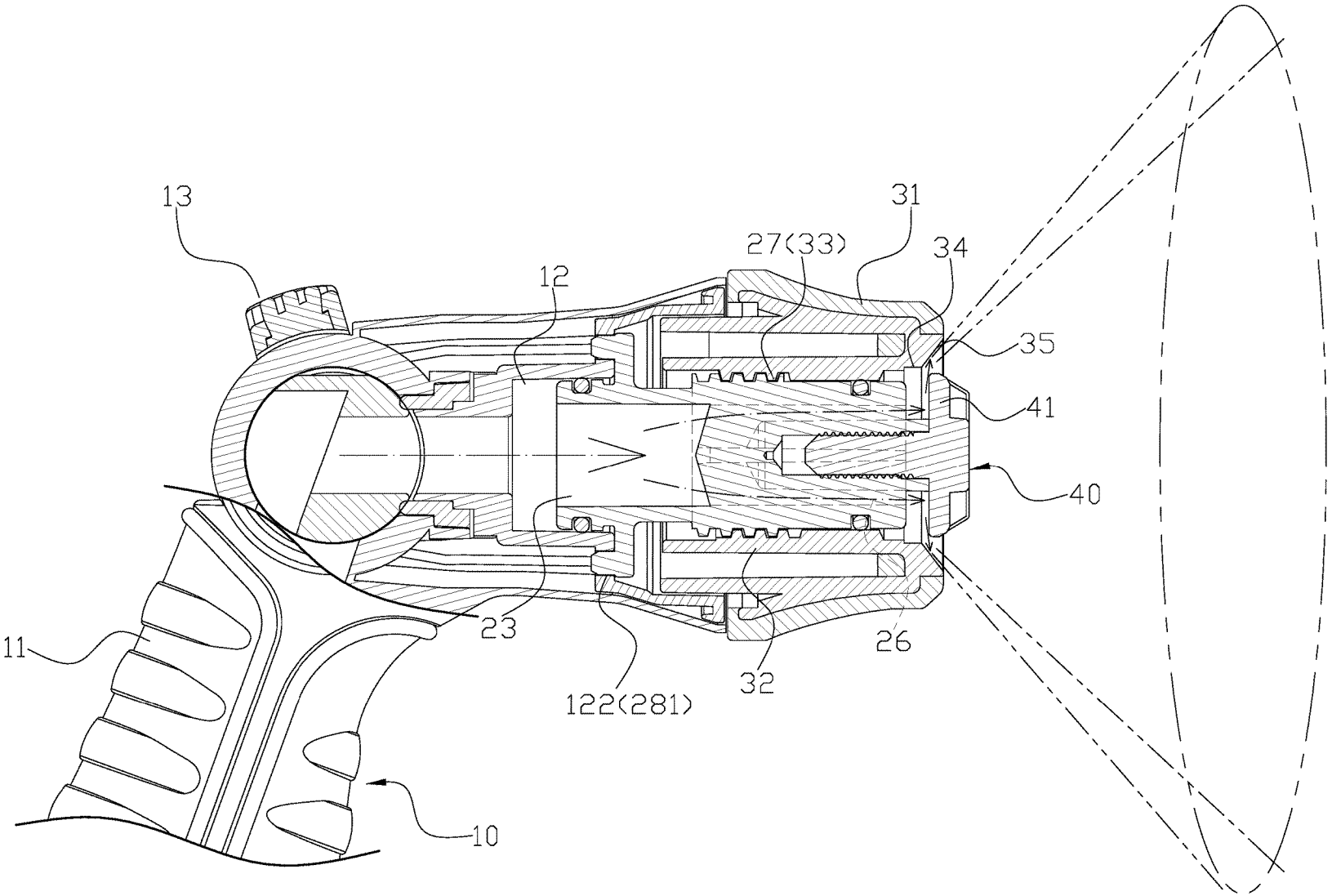
FIG. 5 is schematic view illustrating the water spray gun of the present invention sprays water flow in a full corn pattern.
Figure 6:
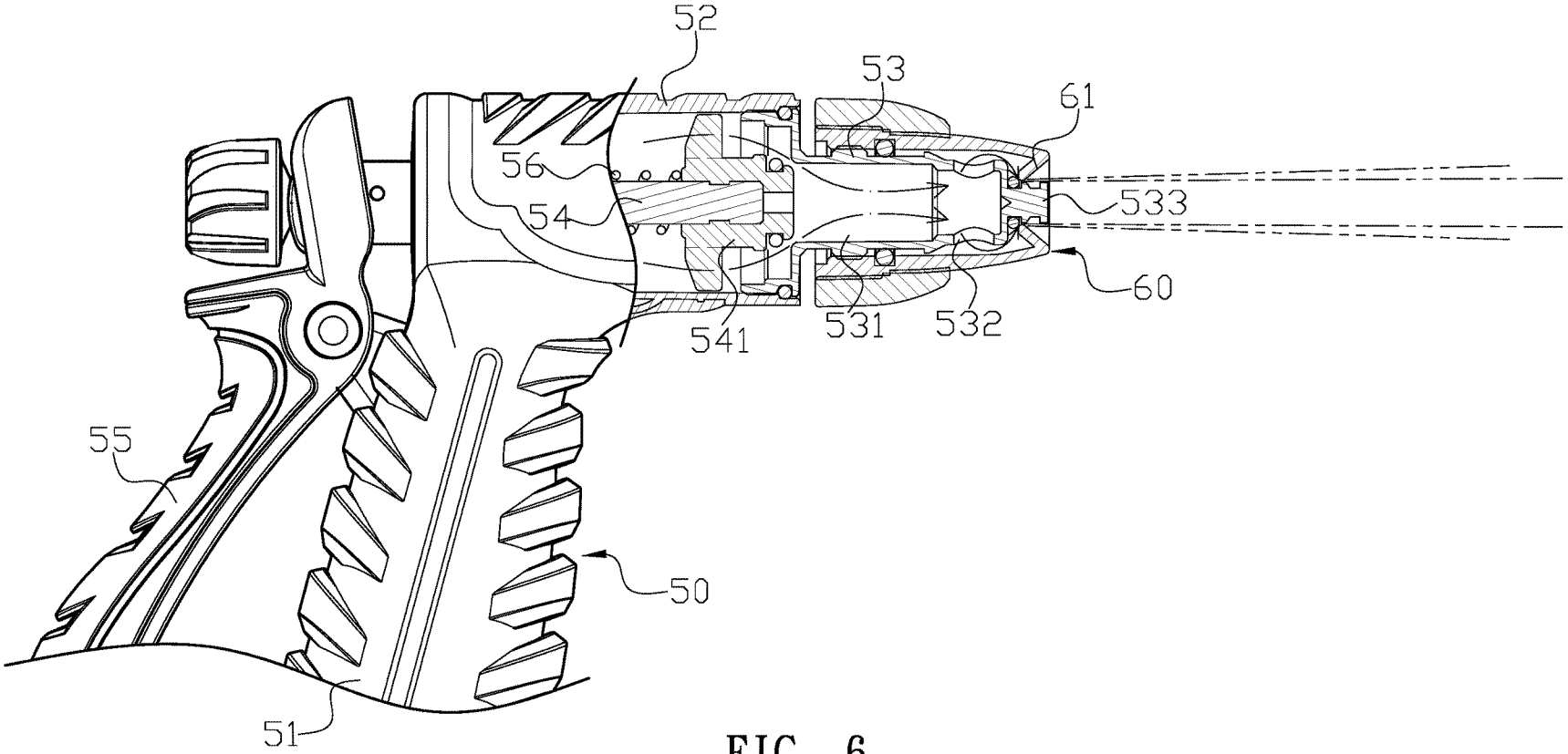
FIG. 6 PRIOR ART
FIG. 6 is a prior art.
Figure 7:
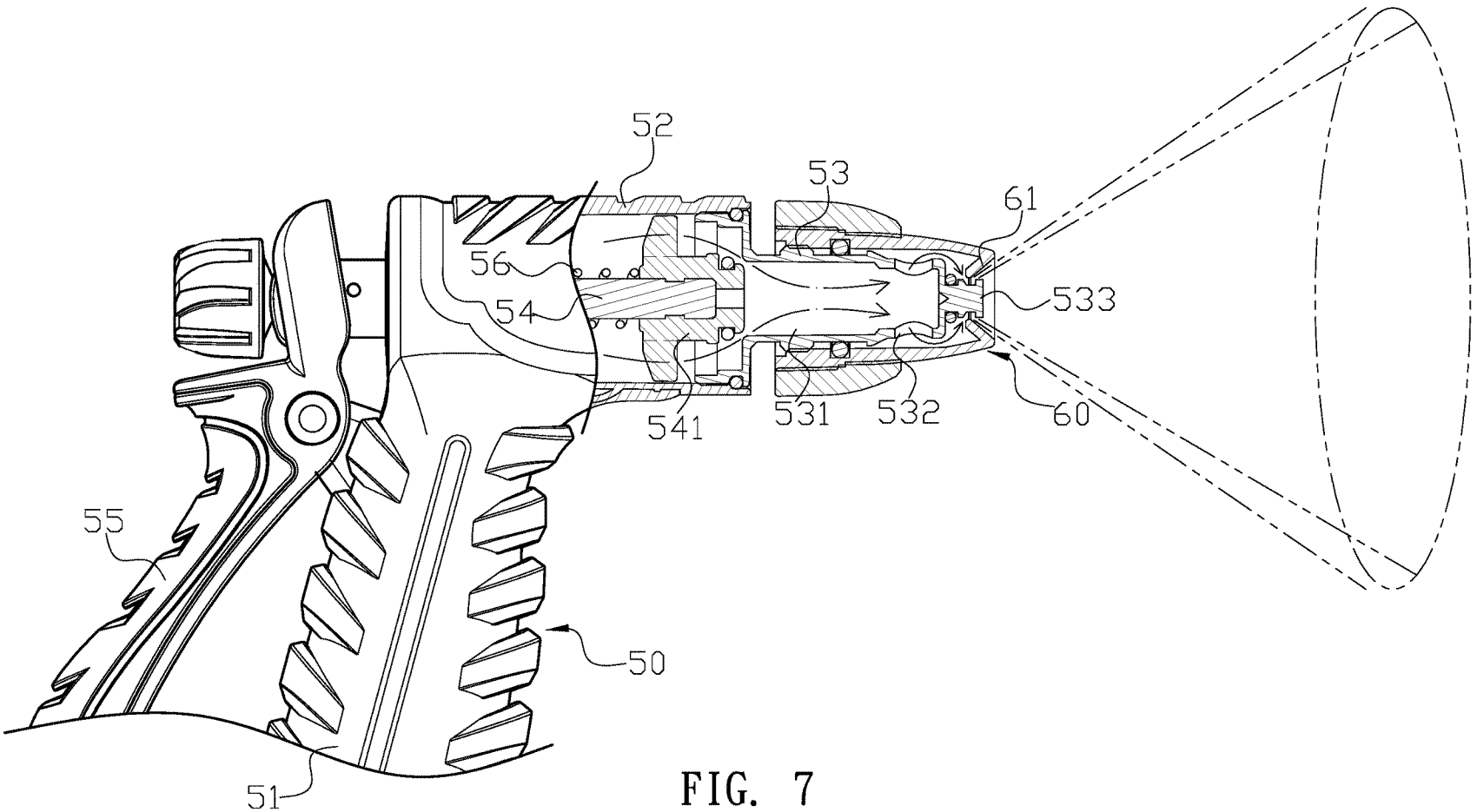
FIG. 7 PRIOR ART
FIG. 7 is a prior art.

In actual application, water flows from the interior space of the handle (11) through the interior space of the barrel portion (12) and the first through hole (23) into the water outlet unit (20), and through the second through holes (26), the water flow can flow toward the knob (40) by flowing in a straight line instead of through multiple transitions. Also, with turning the spray head (30) in clockwise direction or in counter clockwise direction, the blocking piece (41) of the knob (40) is configured to align with the stepped portion (34) or the tilted surface (35) of the spray head (30) to spray water flow out of the water spray gun in a solid stream pattern (as shown in FIG. 4) or a full core pattern (as shown in FIG. 5).

Comparing with conventional water spray gun, the present invention is advantageous because: (i) the spray head (30) is integrally made of plastic material, which simplifies the manufacturing process and lowers the cost; and (ii) through communicating the first through hole (23) with the second through holes (26), the water flow is configured to flow in a straight line thus maintaining the momentum and speed of the water flow to perform different spraying patterns efficiently and to save labors and water.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A water spray gun comprising:

a main body having a handle and a barrel portion, and interior spaces of the handle and the barrel portion communicated with each other, and a connecting opening, which is formed at a front end of the barrel portion, configured to receive and secure a water outlet unit;

the water outlet unit comprising a first connecting portion and a second connecting portion respectively formed at a rear end and a front end thereof, and a first through hole axially penetrating through a central portion of the first connecting portion toward a central portion of the second connecting portion, and a mounting base, which has a screw hole, received in a front portion of the first through hole, and the mounting base connected with the second connecting portion through a plurality of spacers, and a plurality of second through holes, which are formed between the spacers, communicated with the first through hole thereby allowing water flowing in the water spray gun to flow in a straight line and to keep the momentum and speed thereof; the water outlet unit received in the connecting opening of the main body through the first connecting portion, and the second connecting portion of the water outlet unit protruding from the front end of the barrel portion of the main body, and an outer periphery of the second connecting portion having a first threaded segment which is configured to engage and secure a spray head;

the spray head, which is integrally made of plastic material, connected with an outer casing and an inner tube, and a second threaded segment, which is formed at an inner surface of the inner tube, configured to engage with the first threaded segment of the second connecting portion of the water outlet unit; a front end of the inner tube further comprising a tapered stepped portion which is configured to connect to a tilted surface, and a diameter of the stepped portion gradually expanded from a rear end to a front end thereof; and a knob having a blocking piece, and a threaded rod, which protrudes from a first end of the blocking piece, configured to penetrate through the tilted surface to connect to the screw hole of the mounting base.

2. The water spray gun of claim 1, wherein a water valve formed between the handle and the barrel portion of the main body is configured to control on/off operation of the main body to spray water flow.

3. The water spray gun of claim 1, wherein the spacers located on the water outlet unit are formed in cross-shaped.

4. The water spray gun of claim 1, wherein a flange is formed between the first connecting portion and the second connecting portion, and a locating column protruding from a first surface of the flange is configured to connect to a locating hole formed at the connecting opening of the barrel portion of the main body, and with the use of screws, the water outlet unit is configured to be firmly secured on the main body.

* * * * *